US006202451B1

(12) United States Patent
Park et al.

(10) Patent No.: US 6,202,451 B1
(45) Date of Patent: Mar. 20, 2001

(54) POWER TRANSMISSION APPARATUS OF WASHING MACHINES

(75) Inventors: Choul-Woo Park, Suwon; Sang-Chul Bae, Seoul, both of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/233,490

(22) Filed: Jan. 20, 1999

(30) Foreign Application Priority Data

Jul. 1, 1998 (KR) ..... 98-26456

(51) Int. Cl.[7] ..... D06F 23/04
(52) U.S. Cl. ..... 68/23.7; 68/133
(58) Field of Search ..... 68/23.7, 23 R, 68/131, 133

(56) References Cited

U.S. PATENT DOCUMENTS 3,584,482 * 6/1971 Brucken .
3,783,652 * 1/1974 Archbold .
3,914,963 * 10/1975 Briner .
4,434,630 * 3/1984 Ikeda .
4,969,341 * 11/1990 Burk et al. .
5,293,760 * 3/1994 Tani et al. .
5,887,458 * 3/1999 Bae .
5,930,855 * 8/1999 Vande Harr et al. .

* cited by examiner

*Primary Examiner*—Frankie L. Stinson
(74) *Attorney, Agent, or Firm*—Robert E. Bushnell, Esq.

(57) ABSTRACT

A power transmission apparatus of a washing machine, the apparatus employing a wash/spin-dry tub inside and outer tub and an agitating member centrally disposed inside the wash/spin-dry tub for agitating laundry, wherein the apparatus comprises upper and lower cover flanges coupled to a bottom surface of the outer tub for accommodating a driving source underneath the outer tub to generate a driving force and for supporting the driving source, a motor shaft disposed at an inner circumference of a rotor at the driving source to be integrally rotated therewith, a sealing member for sealing a space between the outer tub and the motor shaft the present water from leaking out of the outer tub and for causing the motor shaft to rotate independently from the outer tub, and a ball bearing having an inner ring thereof push-fitted from under the sealing member into an outer circumference of the motor shaft while an outer ring thereof is push-fitted into an inner circumference of the upper cover flange, and a power transmission apparatus of a washing machine.

7 Claims, 10 Drawing Sheets

POWER TRANSMISSION APPARATUS OF WASHING MACHINES

BACKGROUND OF THE INVENTION

1. Field of the Invention

The present invention relates to a power transmission apparatus of clothes washing machines.

2. Description of the Prior Art

The conventional art will be described with reference to the attached drawings. A conventional washing machine, as illustrated in FIGS. 1, 2 and 3, includes a housing 1, water supply means 8 disposed at the back of the housing 1 for supplying water to a washing/spin-dry tub 6 and drain means 9 disposed beneath the washing/spin-dry tub 6 for draining the water in the wash/spin-dry tub 6 out of the washing machine.

The water supply means 8 is arranged thereunder with detergent dissolving means 10 for dissolving detergent in the water to supply into an outer tub 2 and the wash/spin-dry tub 6. The housing 1 is installed therein with the outer tub 2, and the wash/spin-dry tub 6 is provided therein.

Agitating member 7 is disposed on the floor of the wash/spin-dry tub 6 so as to agitate and wash laundry by applying physical force thereto, simultaneously rotating right and left on receipt of power from power transmission means to make the water turbulent.

The out tub 2 is centrally mounted with a washing shaft 11 connected to the agitating member 7 and a spin dry shaft 12 connected to the washing/spin-dry tub 6, and a bearing 13*a* is releasably and rotatably disposed between the washing shaft 11 and the spin-dry shaft 12.

Furthermore, the outer tub 2 is provided at a bottom surface thereof with power generating means 3 for generating power to rotate the washing shaft 11 and the spin-dry shaft 12, decelerating means 4 disposed underneath the power generating means 3 to decelerate a rotary speed transmitted from the power generating means 3 and power switching means 5 for cutting off the power transmitted to the spin-dry shaft 12 during washing and for connecting the power transmitted to the spin-dry shaft 12 during spin-dry process.

Here, the power generating means 3 consists of a stator 31*a,* a rotor 31*b,* a motor 31, a motor shaft 32, and upper and lower housing 33 and 34 for covering the motor 31 and the motor shaft 32. The motor shaft 32 includes a ball bearing 14 disposed between a lower inner circumference thereof and an external peripheral surface of the spin-dry shaft 12 and a metal bearing 13*b* mounted between a lower inner circumference thereof and an external peripheral surface of the washing shaft 11, thereby preventing transfer of rotation at the motor shaft 32. The motor shaft 32 is meshed into a planetary gear 42 in order to transfer turning effect to a plurality of planetary gears 42.

The decelerating means 4 is arranged with an internal gear 41 formed with teeth at an inner circumference thereof, a plurality of planetary gears 42 disposed at an inner circumference thereof to be meshed into the internal gear 41 and to rotate, an upper carrier 23 and a lower carrier 24 respectively disposed above and underneath the plurality gears 42 so as to connect a central shaft 42*a* of the planetary gears 42 and to allow the planetary gears 42 to rotate, and a cover 45 for covering external bottoms of each part.

Here, the lower carrier 44 is centrally coupled to a lower end of the washing shaft 11 by a serration method so as to be cooperatively rotated with the washing shaft 11. The power switching means 5 includes a cam lever 51 rotatably coupled to one side of the upper and lower housings 33 and 34 at the power generating means 3 and having a cam 51*a* thereon, a clutch lever 52 seesawing around a hinge 52*a* according to rotation of the cam 51*a,* a lower clutch 54 integrally coupled to an upper surface of the motor shaft 32, an upper clutch 53 connected at one end thereof to the clutch lever 52 and coupled to a periphery of the spin-dry shaft 12 by serration method for vertical movement and interrupting the power by a meshed operation with the lower clutch 54, a gear lever 55 coupled at a right angle to a lower side of the cam lever 51 to cooperatively rotate according to rotation of the cam lever 51, a first cam 56 meshed to one side of the gear lever 55 to cooperatively rotate and formed at an inner circumference thereof with a guide unit, a second cam 57 formed with a slant guide groove into which the guide unit of the first cam 56 is inserted so as to be vertically moved according to the rotation of the first cam 56, and coil springs 58 and 59 respectively disposed at inner circumferences of the second cam 57 and the lower clutch 54 so as to be compressed and elongated during switch from washing stroke to spin-dry stroke. The internal gear 41 is formed at an upper surface thereof with an insertion groove 41*a* into which one side of the second cam 57 is inserted so as to restrain the rotation of the internal gear 41 by way of downward insertion of the second cam 57 during the washing stroke.

In the washing machine thus constructed, when a desired washing condition is selected and a power is applied during washing process, an adequate amount of water is supplied into the wash/spin-dry tub 6, and when the supply of the water is completed, the motor 31 centrally disposed underneath the outer tub 2 begins to operate.

Successively, as illustrated in FIG. 2, the motor shaft 32 is rotated at a high speed according to operation of the motor 31 and the plurality of planetary gears 42 meshed into the lower end of the motor shaft 32 are rotated.

The lower carrier 44 connected to the central shaft 42*a* of the planetary gears 42 is then rotated to thereby rotate the washing shaft 11 centrally connected to the lower carrier 44 by the serration method.

At this time, the first cam 56 meshed into the gear lever 55 which cooperatively rotates underneath the cam lever 51 by way of the gear lever 55 is rotated at a predetermined circle, and successively, the guide unit of the first cam 56 moves along the guide groove at the second cam 57. At the same time, the second cam 57 is moved downward according to sliding contact with the guide unit of the first cam 51 by resilient force of the coil spring 58 compressed at an inner side of the second cam 57. By this, one side of the second cam 57 is inserted into the insertion groove 41*a* of the internal gear 41 to thereby restrain rotation of the internal gear 41.

Successively, the washing shaft 11 is rotated at a reduced speed according to the planetary gears 42 and the lower carrier 44 which have been reduced in speed thereof because the internal gear 41 is fixed and is not rotated by the restraint of the second cam 57. The agitating member 7 connected to the washing shaft 11 is then rotated reversibly left and right to perform the washing.

Meanwhile, along with the washing operation thus described, the cam 5l*a* is rotated by activation of the cam lever 51 to cause the clutch lever 52 to seesaw around the hinge 52*a,* and successively, the upper clutch 53 connected to one side of the clutch lever 52 is upwardly moved to thereby release the meshed coupling with the lower clutch 54 and to prevent the power of the motor 31 from being transferred to the spin-dry shaft 12.

After the washing thus described is executed, and a predetermined time lapses to complete the washing, the water is drained out, rinsings are performed several times and spin-dry stroke is started. When the spin-dry stroke is started, as illustrated in FIG. 3, the cam 51*a* is rotated by activation of the cam lever 51 and the clutch lever 52 seesaws around the hinge 52*a* to thereby move downward the upper clutch 53 connected to one side of the clutch lever 54. Successively, the spin-dry shaft 12 coupled by the serration method to the inner circumference of the upper clutch 53 can receive rotation of the rotor shaft 32.

When the motor shaft 32 is rotated at a high speed, so does the spin-dry shaft 12, such that the wash/spin-dry tub 6 connected to the spin-dry shaft 12 is also rotated at a high speed to perform the spin-dry.

Meanwhile, when the motor 31 is activated to rotate the motor shaft 32 at a high speed, the plurality of planetary gears 42 meshed into a bottom end of the motor shaft 32 are rotated. At this time, the first cam 56 meshed into the gear lever 55 which is cooperatively rotated under the cam lever 51 rotates at a predetermined radius, by which the guide unit of the first cam 56 moves along the guide groove of the second cam 57. The coil springs 58 is then compressed by the second cam 57, where the second cam 57 slidingly contacts the guide unit of the first cam 51 to move upward. The second cam 57 is detached from the insertion groove 41*a* at the internal gear 41 to release the fixation of the internal gear 41. The internal gear 41 is rotated together according to the rotation of the plurality gears 42.

Subsequently, because the internal gear 41 is rotated with fixation thereof being released, the washing shaft 11 is not reduced in speed by the planetary gears 42 and lower carrier 44 to cause the decelerating means 4 to race. According to the racing of the decelerating means 4, the washing shaft 11 is rotated for a predetermined time to thereafter stop rotating and the spin-dry shaft 12 having received the power from the motor 31 is rotated. The wash/spin-dry tub 6 connected thereto is rotated at a high speed to perform the spin-dry.

SUMMARY OF THE INVENTION

However, there is a disadvantage is the conventional washing machine thus constructed in that construction is complicated and causes an increase in costs of parts. There is another disadvantage in that it generates a driving noise due to complicated construction and causes general size and volume thereof to be increased.

The present invention is disclosed to solve the aforementioned problems and it is an object of the present invention to provide a power transmission apparatus of a washing machine adapted to simplify its construction to thereby reduce costs of parts and noises according to decreased number of parts.

It is another object of the present invention to provide a power transmission apparatus of a washing machine adapted to simplify its construction to thereby reduce an overall size and volume of the washing machine.

In accordance with one object of the present invention, there is provided a power transmission apparatus of a washing machine, the apparatus employing a wash/spin-dry tub inside and outer tub and an agitating member centrally disposed inside the wash/spin-dry tub for agitating laundry, wherein the apparatus comprises:

upper and lower cover flanges coupled to a bottom surface of the outer tub for accommodating a driving source underneath the outer tub to generate a driving force and for supporting the driving source;

a motor shaft disposed at an inner circumference of a rotor at the driving source to be integrally rotated therewith;

a sealing member for sealing a space between the outer tub and the motor shaft the present water from leaking out of the outer tub and for causing the motor shaft to rotate independently from the outer tub; and a ball bearing having an inner ring thereof push-fitted from under the sealing member into an outer circumference of the motor shaft while an outer ring thereof is push-fitted into an inner circumference of the upper cover flange.

In accordance with another object of the present invention, there is provided a power transmission apparatus of a washing machine, the apparatus employing a wash/spin-dry tub inside the outer tub and an agitating member for receiving a power from a driving source centrally disposed within the wash/spin-dry tub to rotate reversibly right and left or rotate to one direction, wherein the apparatus comprises:

decelerating means for receiving a power from a driving source to be meshed into a rotating motor shaft and to decelerate speed of the motor shaft;

a drum coupled at an inner circumference thereof to an outer circumference of an internal gear at the decelerating means and coupled at an outer circumference thereof to the agitating member;

a lower carrier for fixing by a coupling member a lower part of a shaft centrally supporting planetary gears of the decelerating means and a spin-dry flange disposed at a floor of the wash/spin-dry tub;

a plurality of a lower clutches formed at an inner circumference of the upper carrier fixed to an upper part of a shaft of the decelerating means;

power transmission means disposed at an upper side of the lower clutch to vertically move according to existence and non-existence of laundry and to interrupt rotation of the motor shaft and the upper carrier; and sliding means insertedly disposed at a space between an outer circumference of the upper carrier and the drum and at a space between an outer circumference of the motor shaft and the spin-dry flange.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Preferred embodiments of the present invention will now be described in detail with reference to the accompanying drawings.

Figure 1:
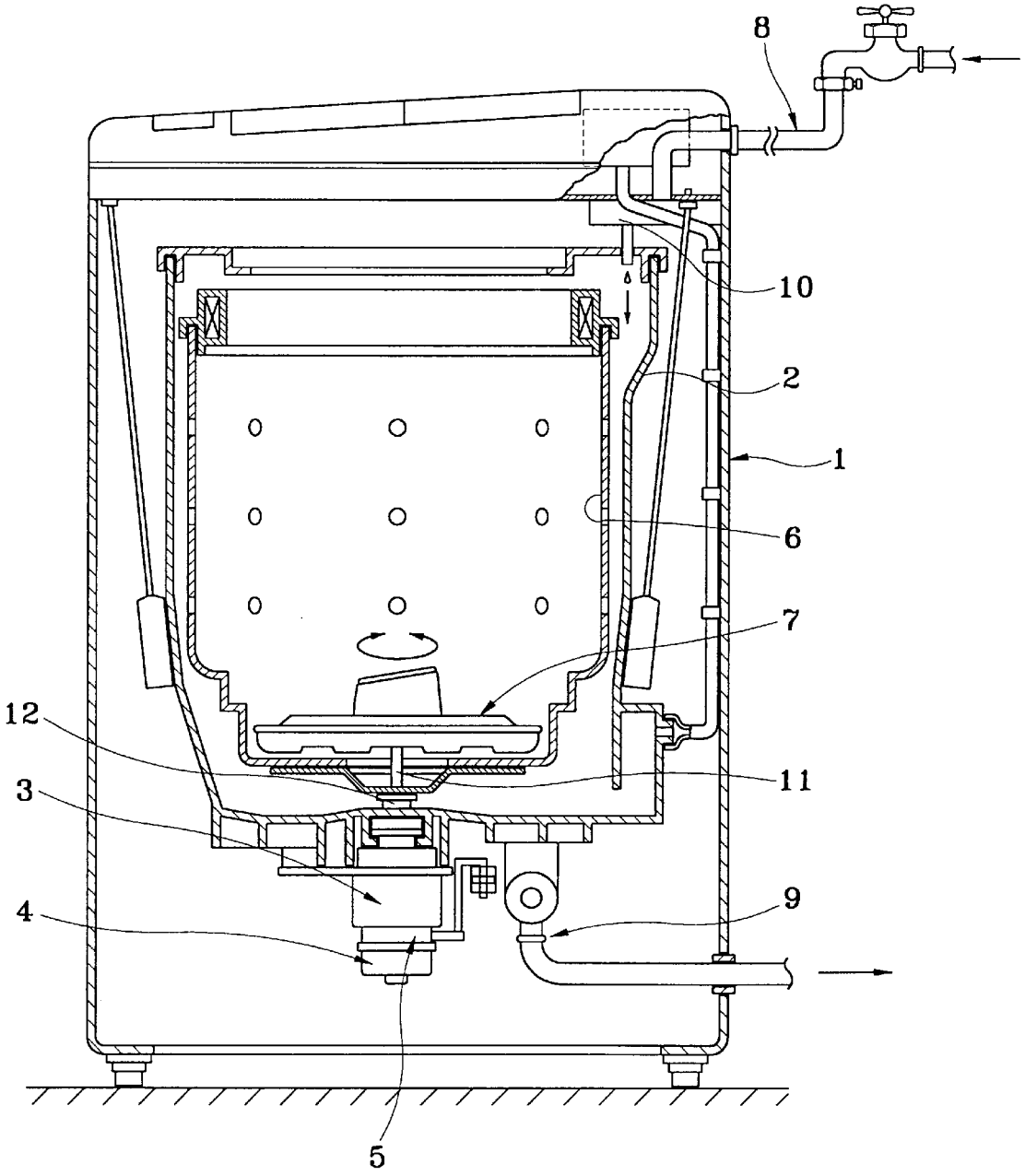
Fig. 1 (Prior Art)
FIG. 1 is a longitudinal sectional view of a conventional washing machine.
Figure 2:
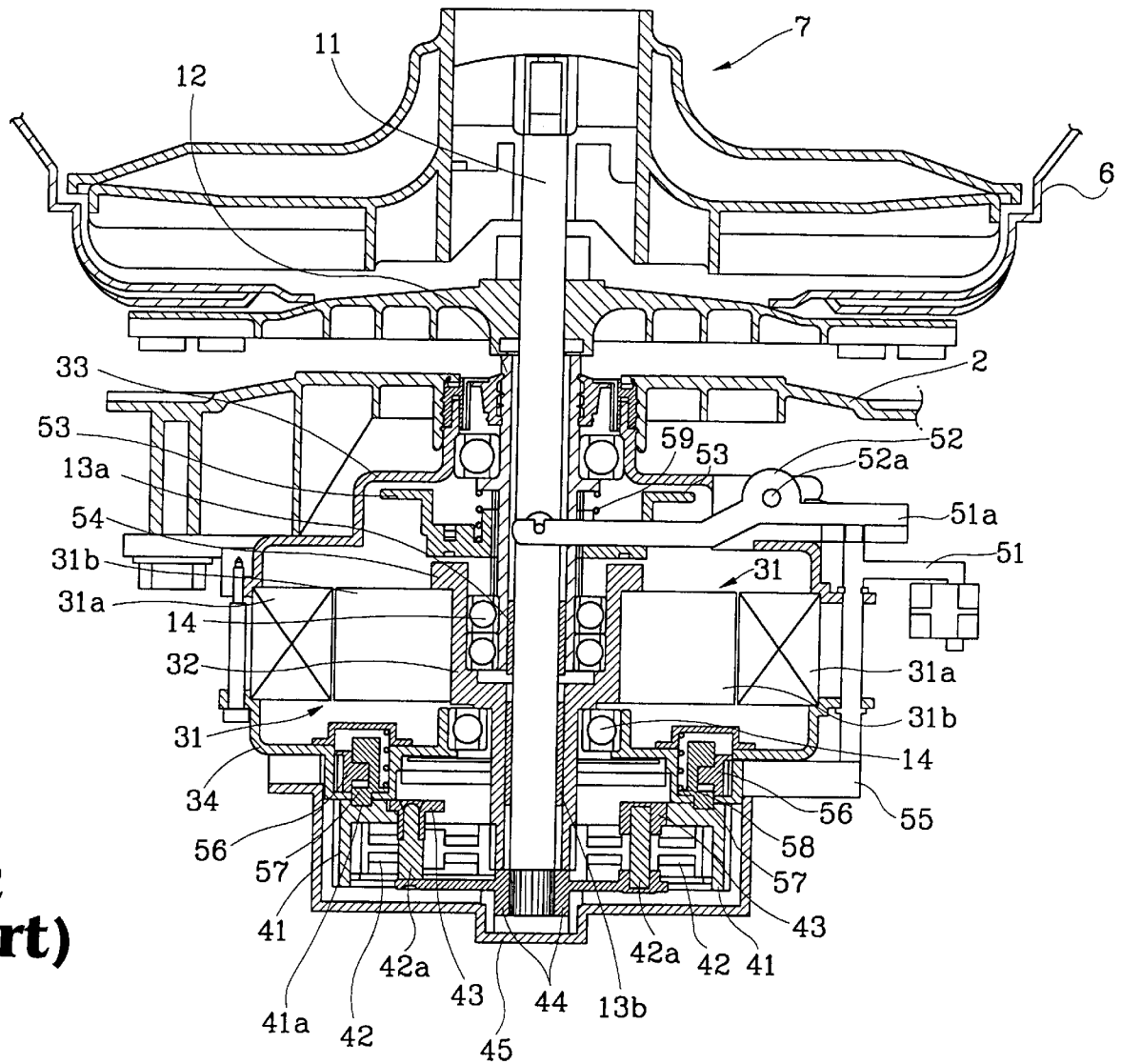
Fig. 2 (Prior Art)
FIG. 2 is a longitudinal sectional view of a conventional washing machine when it performs a washing operation.
Figure 3:
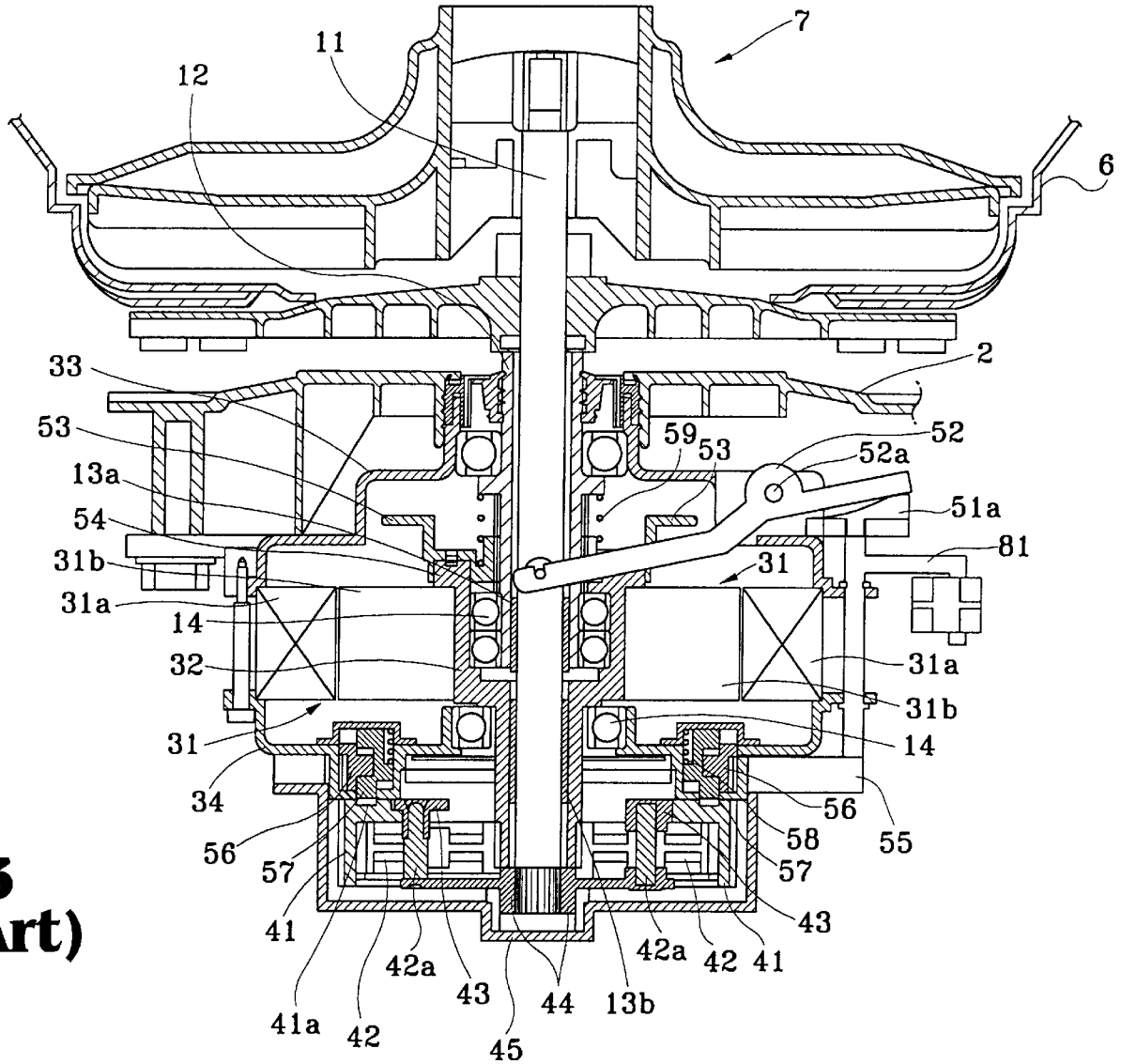
Fig. 3 (Prior Art)
FIG. 3 is a longitudinal sectional view of a conventional washing machine when it performs a spin-dry operation.
Figure 4:
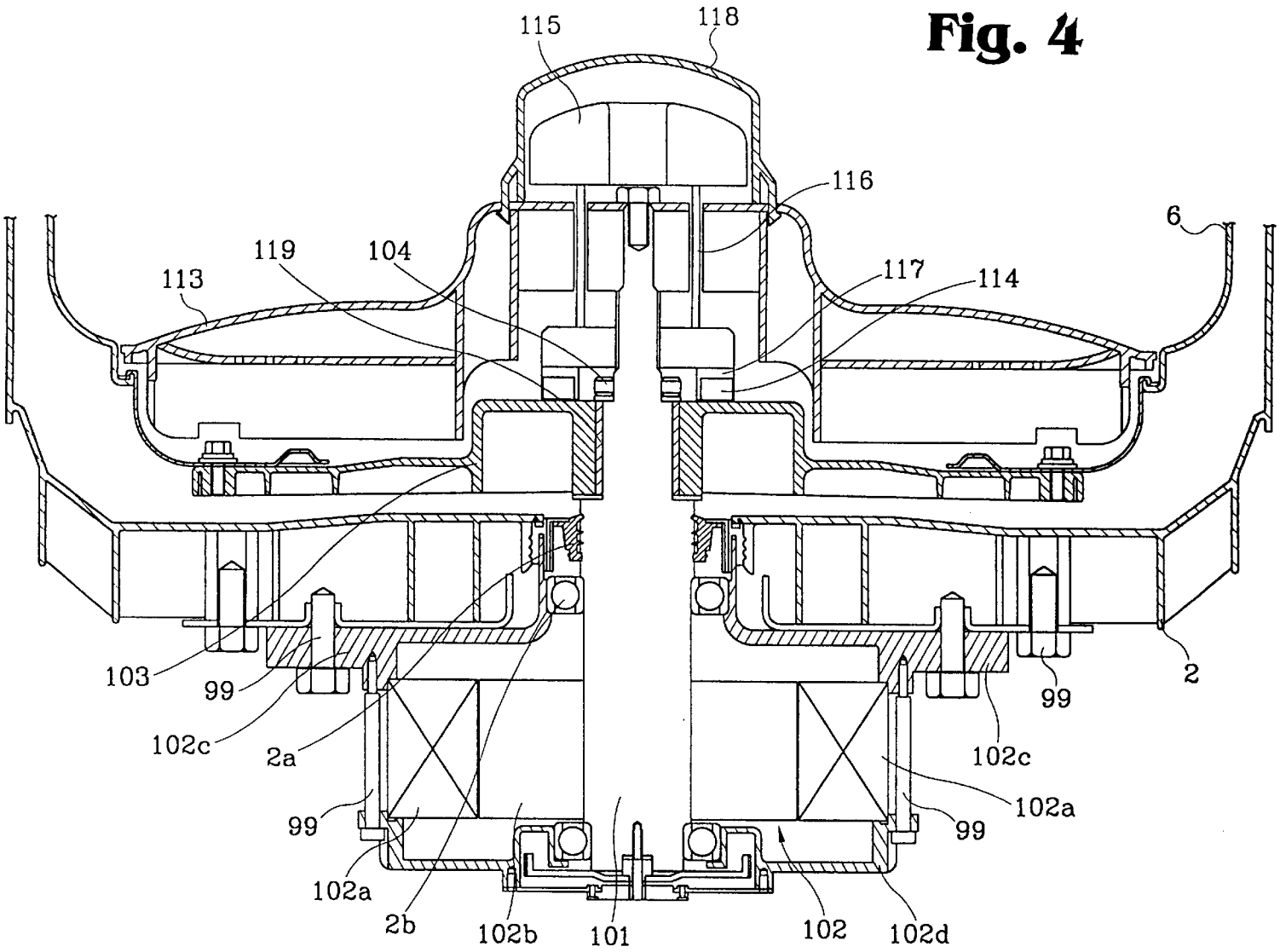
FIG. 4 is a longitudinal sectional view of a washing machine according to a first embodiment of the present invention when it performs a washing operation.
Figure 5:
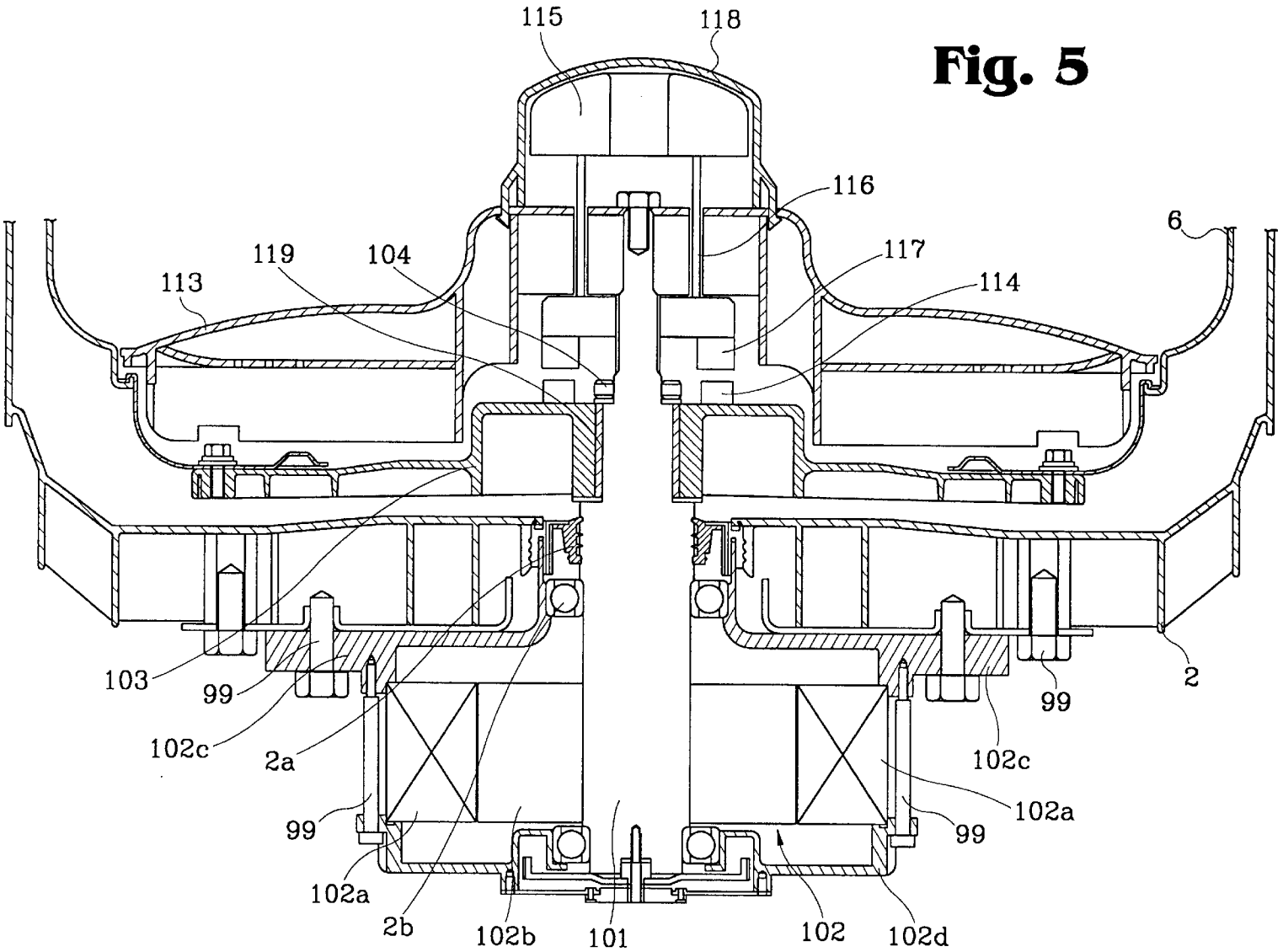
FIG. 5 is a longitudinal sectional view of a washing machine according to the first embodiment of the present invention when it performs a spin-dry operation.

As illustrated in FIGS. 4 and 5, a body 1 in the washing machine is mounted with an outer tub 2. The outer tub 2 is centrally disposed with a motor shaft 101 that receives a power from a driving source 102 to thereby rotate, where the driving source 102 includes a stator 102*a* and a rotor 102*b*. The rotor 102*b* is push-fitted at an inner circumference thereof by the motor shaft 101 to rotate cooperatively.

The driving source 102 is coupled at upper and lower sides thereof with upper and lower cover flanges 102*c* and 102*d* by a coupling member 99, and the upper cover flange 102*c* is coupled to a bottom surface of the outer tub 2 by the coupling member 99. The outer tub 2 is disposed therein with a sealing member 2*a* for sealing a space between the outer tub 2 and the motor shaft 101 to prevent water from leaking out of the outer tub 2 and for causing the motor shaft 101 to rotate independently from the outer tub 2 and a ball bearing 2*b* having an inner ring thereof push-fitted from under the sealing member 2*a* into an outer circumference of the motor shaft 101 while an outer ring thereof is push-fitted into an inner circumference of the upper cover flange 102*c*.

The motor shaft 101 is mounted with a spin-dry tub flange 103 coupled to a bottom end of the wash/spin-dry tub 6 in the outer tub 2 to cooperatively move with the wash/spin-dry tub 6, and a nut 104 is coupled to an upper portion of the spin-dry flange 103 in order to prevent the spin-dry flange 103 from being detached from the motor shaft 101 when the flange 103 is rotated.

The spin-dry flange 103 is arranged thereon with a lower clutch 114 having a plurality of protruders radically formed, spaced a given distance away from each other, and the lower clutch 114 is provided thereon with an upper clutch 117 employing a plurality of protruders of the lower clutch 114 which they move vertically. The upper clutch 117 is disposed thereon with a buoy box 115 connected by a connecting rod 116.

The connecting rod 116 is so disposed as to pierce the agitating member 113 coupled to an upper end of the motor shaft 101. In other words, the agitating member 113 rotates in cooperation with rotation of the upper clutch 117. The agitating member 113 is centrally mounted with a buoy box cover 118 in order to limit an ascending height of the buoy box 115 to a predetermined level. Furthermore, between an exterior circumference of the motor shaft 101 and the spin-dry flange 103 is inserted a sleeve 119 for sliding motion therebetween.

Now, operations of the power transmission apparatus of a washing machine thus constructed according to the first embodiment of the present invention will be described.

An electric power is applied to the driving source 102 to rotate the rotor 102*b* according to magnetic field formed at the stator 102*a*. The motor shaft 101 centrally positioned in the rotor 102*b* rotates in cooperation with the rotor 102*b*.

First of all, when water is supplied into the wash/spin-dry tub 6, the buoy box 115 is raised by the water and the upper clutch 117 formed underneath the buoy box 115 is detached from the lower clutch 114.

In other words, rotation of the agitating member 113 connected to the upper end of the motor shaft 101 is not transmitted to the wash/spin-dry tub 6, such that the agitating member 113 is reversibly rotated right and left while the wash/spin-dry tub 6 is stopped, thereby agitating the laundry.

Of course, the driving source 102 is operated to cause the agitating member 113 to reversibly rotate right and left at a slower speed in washing mode than in spin-dry mode, and the agitating member 113 is operated to rotate in one direction at a faster speed in spin-dry mode than in washing mode.

Next, the water in the wash/spin-dry tub 6 is drained in the spin-dry mode to descend the buoy box 115, by which the upper clutch 117 is descended to be engaged in between the protruders of the lower clutch 114. The agitating member 113 is rotated according to the rotation of the motor shaft 101, to rotate the wash/spin-dry tub 6 and to thereby spin-dry the laundry therein.

Now, operation of the power transmission apparatus of a washing machine according to the second embodiment of the present invention will be described with reference to FIGS. 6, 7 and 8.

Figure 6:
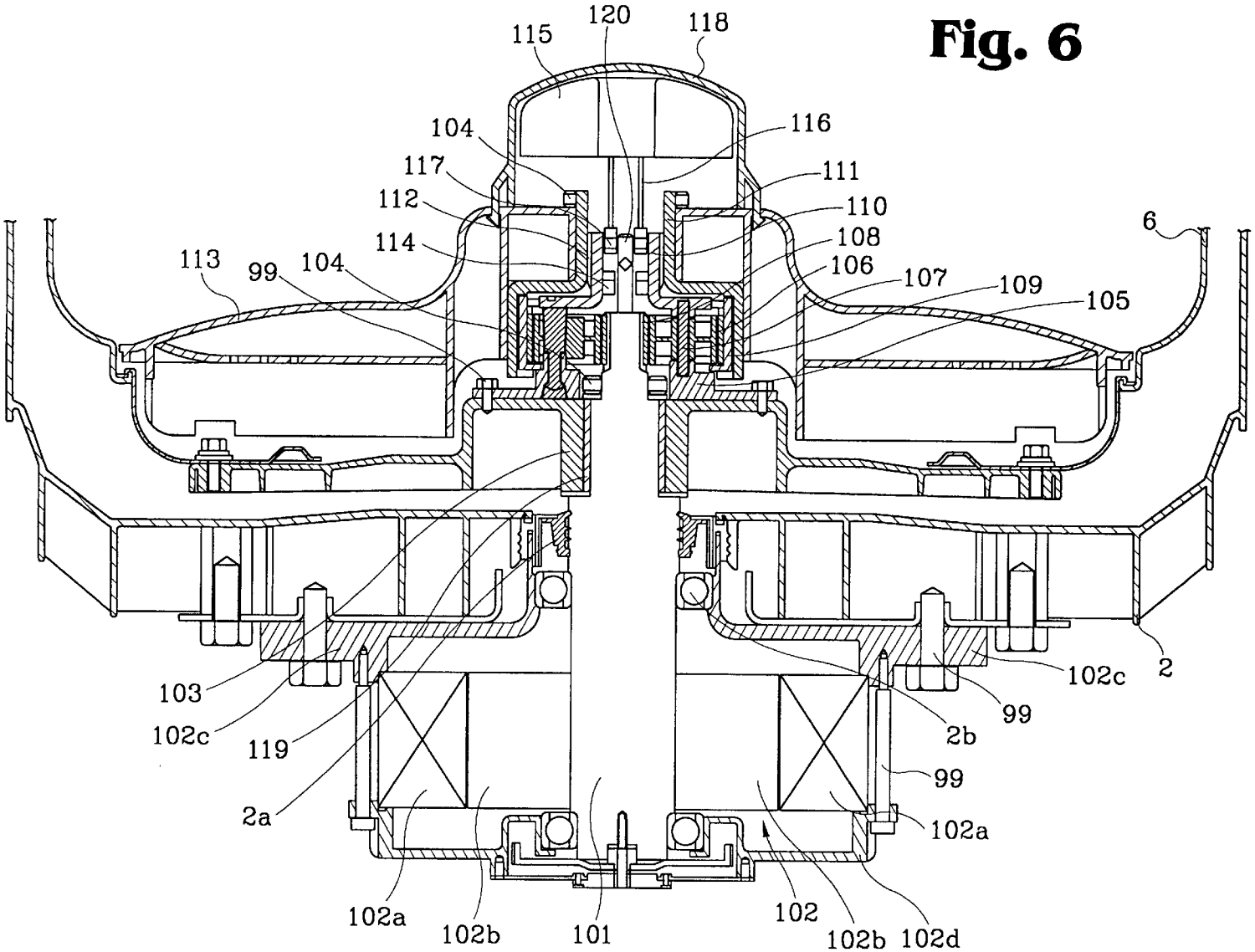
FIG. 6 is a longitudinal sectional view of a washing machine according to a second embodiment of the present invention when it performs a washing operation.
Figure 7:
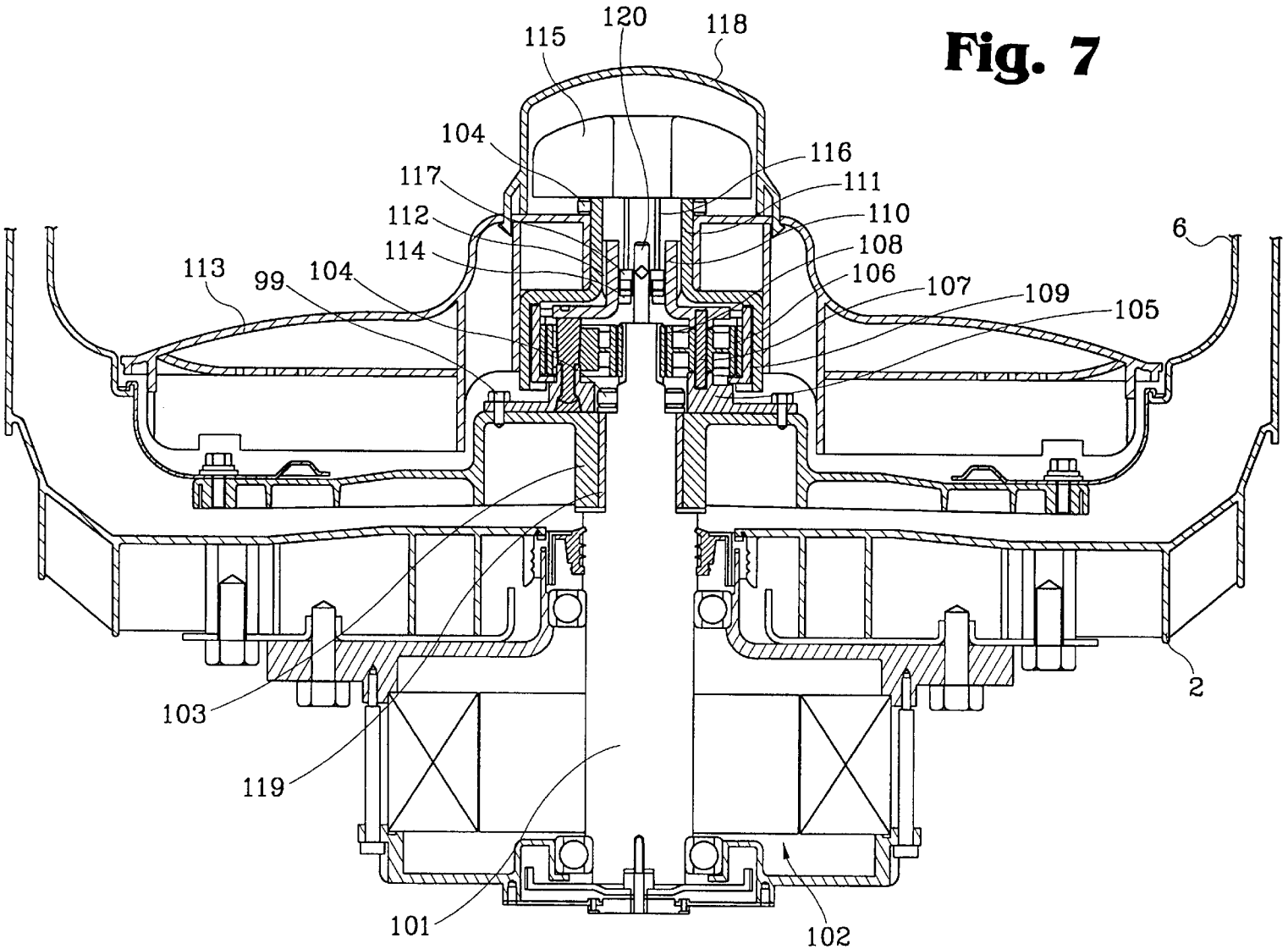
FIG. 7 is a longitudinal sectional view of a washing machine according to the second embodiment of the present invention when it performs a spin-dry operation.
Figure 8:
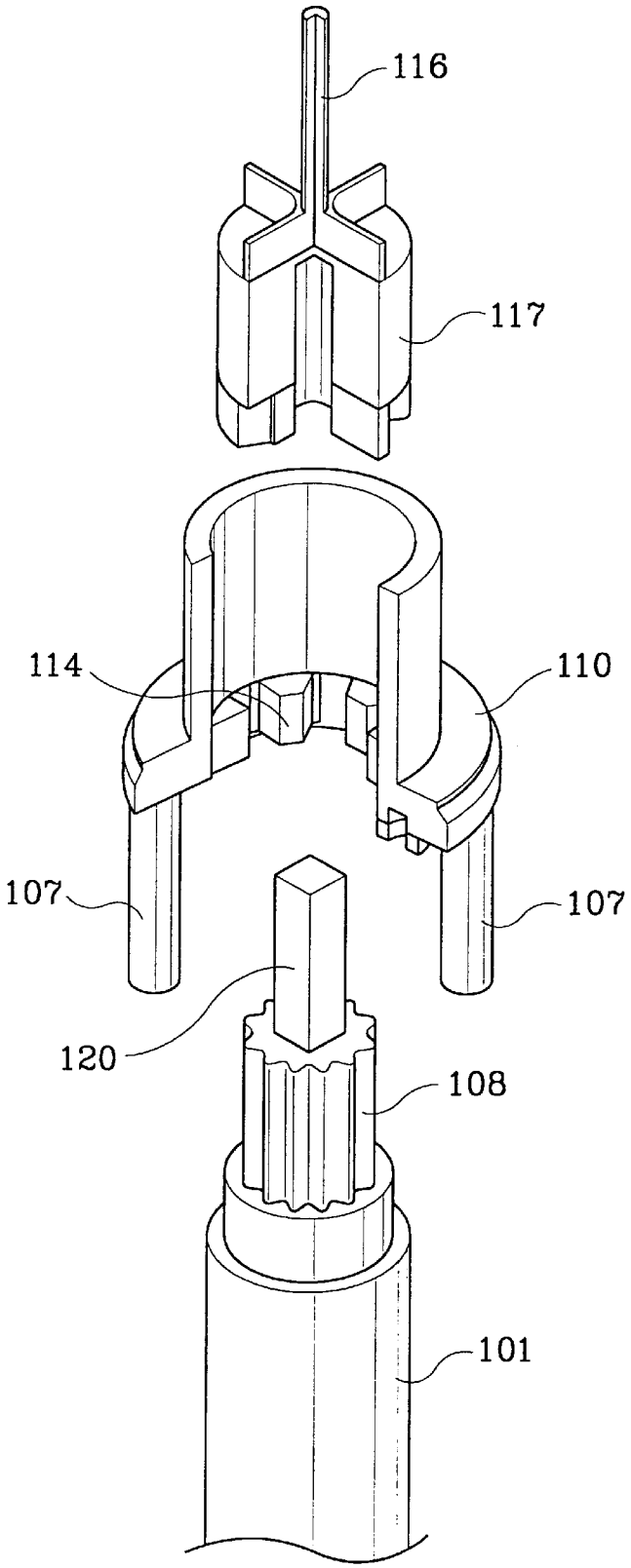
FIG. 8 is an exploded perspective view of power transmission means at a washing machine according to the second embodiment of the present invention.

As illustrated in the FIGS. 6, 7 and 8, at an upper end of the motor shaft 101 rotating upon receipt of power of the driving source 102 there is disposed decelerating means for reducing the speed of the motor shaft 101. A drum 111 is positioned between the internal gear 109 of the decelerating means and the agitating member 113 to transmit the rotation reduced in speed from the decelerating means to the agitating means 113. The lower carrier 105 coupled to the spin-dry flange 103 by coupling member 99 is disposed between a lower portion of a shaft 108 centrally supporting the planetary gears 106 at the decelerating means and the spin-dry flange 103 positioned on the floor of the wash/spin-dry tub 106.

The lower clutch 114 having a plurality of protruders, each formed at a predetermined space, is provided at an inner circumference of the upper carrier 110 fixed to an upper portion of the shaft 107 at the decelerating means. On upper side of the lower clutch 114 there is arranged power interrupting means for vertically moving according to existence or non-existence of the washing water to interrupt rotation of the motor shaft 101 and the upper carrier 110, slide means is inserted into a space between an exterior circumference of the upper carrier 110 and the drum 111 and into a space between an exterior circumference of the motor shaft 101 and the spin-dry tub flange 103.

Here, the decelerating means includes a sun gear 108 formed at the motor shaft 101, planetary gears 106 coupled by a plurality of gears at an exterior circumference of the sun gear 108, an internal gear 109 meshed into an exterior circumference of the planetary gears 106 and a shaft 108 centrally and rotatatively supported to the planetary gears 106.

The power interrupting means thus described includes a buoy box 115 disposed on a central rotating line of the agitating member 113 and filled with a predetermined quanity of air so as to be buoyed up according to the water, and an upper clutch 117 connected to a lower end of the buoy box 115 by way of a connecting rod 116 and formed with a groove through which a rectangular unit 120 extensively formed at an upper end of the motor shaft 101 is inserted and formed at a given distances so as to be meshed into the lower clutch 114.

Furthermore, the slide means is mounted with a metal bearing 112 inserted into a space between an exterior circumference of the upper carrier 110 and an inner circumference of the drum 111 and a sleeve 119 inserted into a space between the motor shaft 101 and the spin-dry tub flange 103.

In other words, the internal gear 109 is disposed at an exterior circumference thereof with the drum 111 push-fitted thereinto, and the drum 111 is inserted at an upper inner circumference thereof with the metal bearing 112 so that a bearing 112 can separately rotate at a space between the upper carrier 110 and the drum 111. The drum 111 is arranged at a periphery thereof with the agitating member 113 coupled by a nut 104 for fastening the upper portion of the drum 111.

Now, the following description relates to the operation of a power transmission apparatus of a washing machine according to the second embodiment of the present invention.

First of all, when a power is applied to the driving source 102 to rotate the motor shaft 101 in the washing mode, the sun gear 108 formed at the upper periphery of the motor shaft is rotated to reversely rotate the plurality of planetary gears 106 meshed thereto.

The internal gear 105 engaged with the periphery of the planetary gears 106 is rotated at the same reduced speed and direction as that of the plurality gears 106.

At the same time, the drum 111 disposed at a periphery of the internal gear 105 is rotated to thereby rotate the agitating member 113 in the reverse direction of the motor shaft 101. Furthermore, the upper and lower carriers 110 and 105 connecting shaft 107 of the planetary gears 106 from upper and lower side thereof are rotated in more reduced speed than that of the motor shaft 104 to thereby rotate the spin-dry tub flange 103 fastened to the lower carrier 105 by coupling member 99. The wash/spin-dry tub is thereafter rotated. In other words, the wash/spin-dry tub 6 and the agitating member 113 are reversely rotated to perform the washing.

The buoy box 115 is descended because there is not water in the wash/spin-dry tub in spin-dry mode to cause the upper clutch 117 formed thereunder to be engaged with the lower clutch 114 formed at the upper carrier 110.

When the motor shaft 101 rotates at a high speed under this state, the upper carrier 110 engaged with the upper clutch 117 is also rotated at a high speed and the lower carrier 105 is rotated by the shaft 107 connected to the upper carrier 110. The spin-dry tub flange 103 and the wash/spin-dry tub 6 are also rotated at high speed to spin-dry the laundry.

In other words, the sun gear 108, the planetary gears 106 and the internal gear 109 are all engaged and rotated integrally in spin-dry mode and the drum 111 and the agitating member 113 are simultaneously rotated.

Now, the operation of the power transmission apparatus according to the third embodiment of the present invention will be described in reference to FIGS. 9 and 10, where construction thereof is illustrated.

Figure 9:
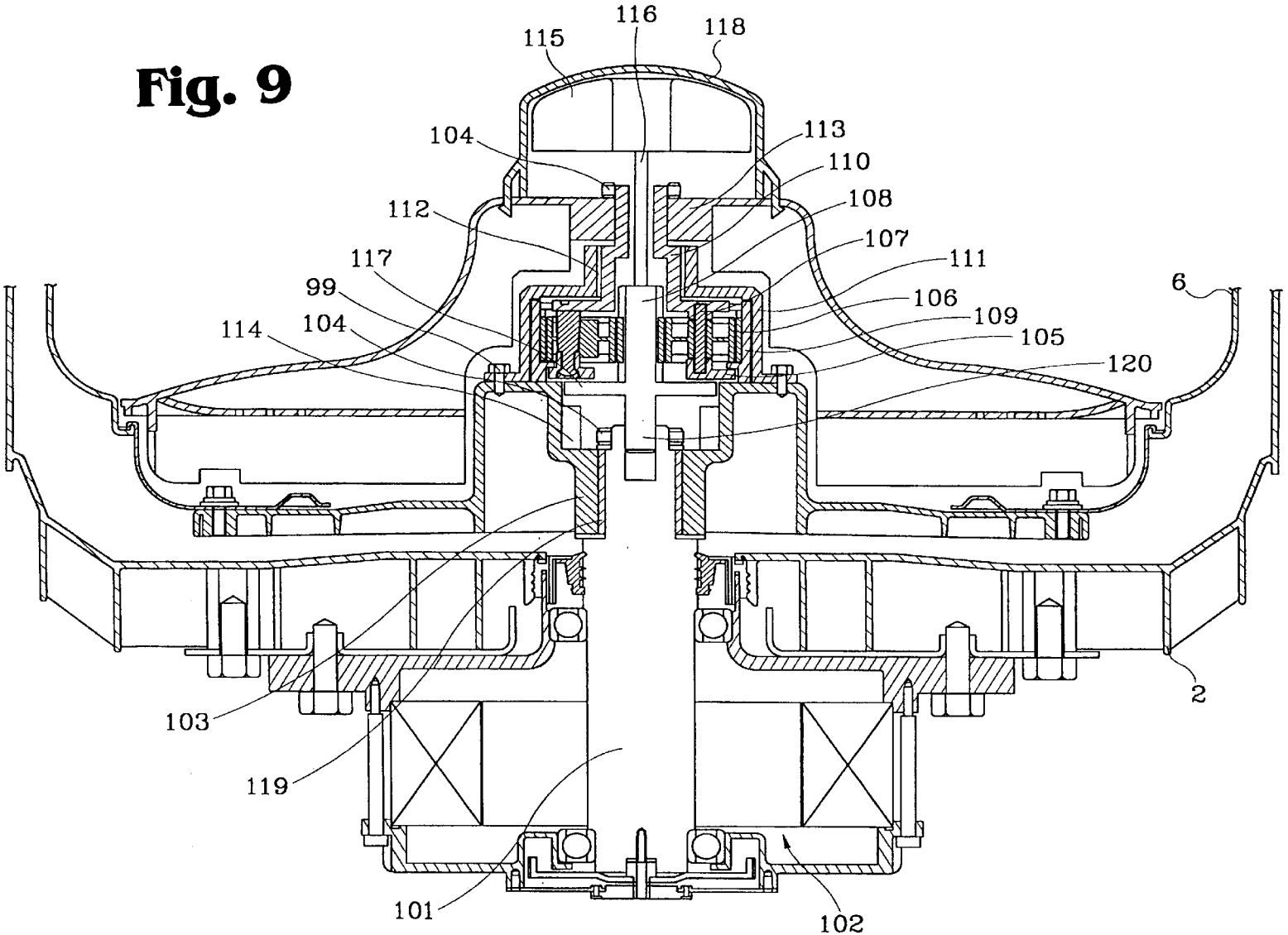
FIG. 9 is a longitudinal sectional view of a washing machine according to a third embodiment of the present invention when it performs a washing operation.
Figure 10:
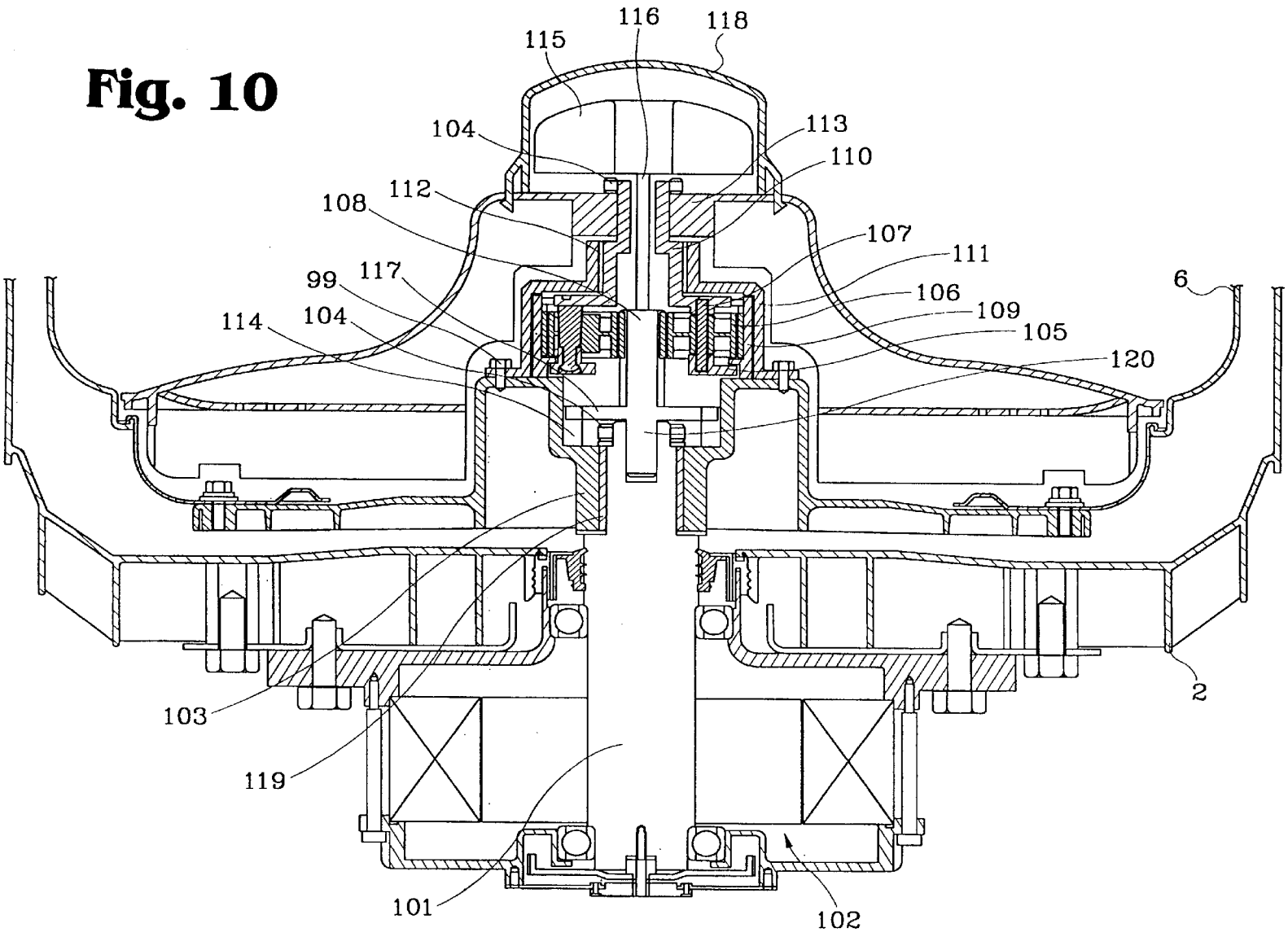
FIG. 10 is a longitudinal sectional view of a washing machine according to the third embodiment of the present invention when it performs a spin-dry operation.

As illustrated in FIGS. 9 and 10, a "+" shaped member is connected by the connecting rod 116 to a bottom end of the buoy box 115 which vertically moves according to existence and non-existence of the laundry, and the "+" shaped member is formed at an upper periphery thereof with the sun gear 108.

The sun gear 108 is formed at left and right extensions thereof with the upper clutch 117, and is formed thereunder with a rectangular unit 120 which is inserted into the motor shaft 101. The upper clutch 117 is formed thereunder with the lower clutch 114 which moves vertically according to buoyance.

Now, operation of the third embodiment according to the present invention thus constructed will be described.

In washing mode, the buoy box 115 is ascended by buoyance of the washing water, and the upper clutch 117 of "+" shaped member connected to bottom end of the connecting rod 116 is detached from the lower clutch 114, where the rectangular unit 120 formed underneath the "+" shaped member is inserted into the motor shaft 101.

At this time, when the power is applied, the motor shaft 101 which has received the power from the driving source 102 is rotated, and the sun gear 108 of "+" shaped member is rotated to thereby rotate the planetary gears 106. The upper carrier 110 at the shaft 107 inserted into the planetary gears 106 is rotated in reduced speed to rotate the agitating member 113 engaged thereto.

The internal gear 109 which has received the reduced rotating speed from the planetary gears 106 rotates the drum 111 formed at an external side thereof to thereafter rotate the spin-dry tub flange 103 and the wash/spin-dry tub 6.

In other words, the agitating member 113 is rotated in reverse direction from that of the wash/spin-dry tub 6 to thereby increase the washing efficiency.

In spin-dry mode, the buoy box 115 and the "+" shaped member are descended according to discharge of the washing water to thereby cause the upper clutch 117 engaged with the lower clutch 114.

When the motor shaft 101 is rotated under this state, the spin-dry tub flange 103 and the wash/spin-dry tub 6 are rotated at high speed, and by which, the drum 111 fixed onto the spin-dry tub flange 103 and the upper carrier 110 are also rotated at the same high speed to thereby rotate the agitating member 113.

In other words, reduction in speed at the motor shaft 101 is not realized and gears at the decelerating apparatus are mutually meshed to rotate together.

As apparent from the foregoing, there is an advantage in the power transmission apparatus of a washing machine according to the present invention in that an integrally motor shaft is installed at an inner circumference of a rotor at a driving source disposed in upper and lower cover flanges mounted underneath an outer tub, a decelerating apparatus is arranged at an upper side of the motor shaft and interrupting means for interrupting the power of the motor shaft is provided thereon, such that parts for transmitting the power according to washing and spin-drying have been markedly reduced and noises are attenuated.

There is another advantage in that agitating member and wash/spin-dry tub are reversely rotated in the washing mode to thereby increase the washing efficiency.

What is claimed is:

1. A power transmission apparatus of a washing machine the apparatus employing an outer tub, a wash/spin-dry tub inside said outer tub, and an agitating member disposed inside said wash/spin-dry tub for agitating laundry, comprising:

upper and lower cover flanges coupled to a bottom surface of said outer tub for accommodating a driving source between said upper and lower flanges and for supporting said driving source;

a motor shaft extended from said driving source through said outer tub and said wash/spin-dry tub;

a sealing member for sealing a space between said outer tub and said motor shaft to prevent water contained inside said outer tub from leaking out of said outer tub and for causing said motor shaft to rotate independently from said outer tub;

a ball bearing having an inner ring thereof push-fitted into an outer circumference of said motor shaft while an outer ring thereof is push-fitted into an inner circumference of said upper cover flange; and a decelerator disposed between said outer tub and said agitating member, coupled to sid motor shaft, receiving a rotation power from said motor shaft, generating a decelerated rotation power, transmitting said decelerated rotation power to said agitating member.

2. A power transmission apparatus of a washing machine, the apparatus employing an outer tub, a wash/spin-dry tub inside said outer tub, and an agitating member disposed within said wash/spin-dry tub, comprising:

a motor having a shaft extended from said motor through said wash/spin-dry tub;

decelerating means coupled between said shaft and said agitating member to receive a rotation power from said shaft and to decelerate said rotation power and transmit the decelerated rotation power to said agitating member;

a drum coupled at an inner circumference thereof to an outer circumference of said decelerating means and coupled at an outer circumference thereof to said agitating member;

a lower carrier for fixing a lower part of said decelerating means to a spin-dry flange of said wash/spin-dry tub;

an upper carrier disposed between said shaft and said drum, having a lower clutch fixed to an upper part of a shaft of said decelerating means;

power transmission means disposed at an upper side of the lower clutch to vertically move according to existence and non-existence of laundry and to interrupt between said shaft and said lower clutch of said upper carrier; and sliding means insertedly disposed at a space between an outer circumference of the upper carrier and the drum and at a space between an outer circumference of the motor shaft and the spin-dry flange.

3. The apparatus as defined in claim 2, wherein the decelerating means comprises:

a sun gear formed at the motor shaft;

a planetary gears coupled by a plurality of gears at an exterior circumference of the sun gear;

an internal gear meshed into an exterior circumference of the planetary gears; and a shaft centrally and rotatatively supported to the planetary gears.

4. The apparatus as defined in claim 2, wherein the power interrupting means comprises:

a buoy box disposed on a central rotating line of the agitating member and filled with a predetermined quanity of air so as to be buoyed up according to the water; and an upper clutch connected to a lower end of the buoy box by way of a connecting rod and formed with a groove through which a rectangular unit extensively formed at an upper end of the motor shaft is inserted and formed at a given distance so as to be meshed into the lower clutch.

5. The apparatus as defined in claim 4, the apparatus comprising:

a "+" shaped member connected by connecting rod to a bottom end of buoy boy;

a sun gear disposed at an upper exterior circumference of the "+" shaped member;

an upper clutch formed at left and right lower extensions of the sun gear; and a rectangular unit disposed at an extended portion thereunder for being inserted into the motor shaft.

6. The apparatus as defined in claim 2, wherein the agitating member is coupled to and cooperatively move with an upper exterior circumference of upper carrier.

7. The apparatus as defined in claim 2, wherein the slide means comprises:

a metal bearing inserted into a space between an exterior circumference of the upper carrier and an inner circumference of the drum; and a sleeve inserted into a space between the motor shaft and the spin-dry tub flange.

* * * * *